US005853238A

United States Patent [19]

Cullen et al.

[11] Patent Number: 5,853,238

[45] Date of Patent: Dec. 29, 1998

[54] RETROFIT CABINET DOOR ASSEMBLY

[75] Inventors: Michael G. Cullen, Sterling Heights; Thomas P. Cullen, Fraser, both of Mich.

[73] Assignee: Elite Corporate Concepts, Warren, Mich.

[21] Appl. No.: 865,690

[22] Filed: May 30, 1997

[51] Int. Cl.[6] ..... A47B 88/00; E05D 15/06

[52] U.S. Cl. ..... 312/304; 312/350; 312/139.2; 49/413

[58] Field of Search ..... 312/304, 138.1, 312/139.2, 349, 350; 49/404, 413

[56] References Cited

U.S. PATENT DOCUMENTS

| | | | |
|---|---|---|---|
| 2,079,138 | 5/1937 | Winn | 49/413 |
| 3,389,943 | 6/1968 | Jones et al. | 312/350 |
| 4,148,535 | 4/1979 | Fenwick | 312/304 |
| 4,274,688 | 6/1981 | Zacky | 312/304 |
| 4,575,966 | 3/1986 | Gerritsen | 49/404 X |
| 4,941,901 | 7/1990 | Ramakrishnan et al. . | |
| 5,254,972 | 10/1993 | Cordio, Jr. | 49/404 X |
| 5,261,189 | 11/1993 | Chu | 49/404 |
| 5,345,717 | 9/1994 | Mori et al. | 49/404 |
| 5,575,321 | 11/1996 | Currier | 49/404 X |

FOREIGN PATENT DOCUMENTS

| | | | |
|---|---|---|---|
| 093018260 | 9/1993 | WIPO | 49/404 |

*Primary Examiner*—Peter M. Cuomo
*Assistant Examiner*—Hanh V. Tran
*Attorney, Agent, or Firm*—Bliss McGlynn, P.C.

[57] ABSTRACT

A retrofit cabinet door assembly for a steam cabinet includes a door frame and a removable door track. The retrofit cabinet door assembly also includes a removable door positioned within the door frame and engaging the door track for movement within the door frame along the door track.

19 Claims, 3 Drawing Sheets

RETROFIT CABINET DOOR ASSEMBLY

BACKGROUND OF THE INVENTION

1. Field of the Invention

The present invention relates generally to steam cabinets and, more particularly, to a retrofit cabinet door assembly for use with a steam cabinet.

2. Description of the Related Art

Many food service lines, especially those used in the fast food industry, are designed to maintain food at the proper serving temperature in order to provide hot food to the consumer upon demand. In short, steam cabinets are often used in food service lines to keep food warm prior to serving. Those components or ingredients that can be preheated usually are. Upon receiving an order, an individual preparing the food opens the steam cabinet, removes the necessary items to prepare the chosen entree, and then closes the steam cabinet. This process is repeated literally hundreds, if not thousands of times during a normal work day.

As expected, existing steam cabinet doors, along with corresponding door tracks, guides and door bumpers, are subject to wear. At some point, the wear increases to the point that the doors become loose, bind in the door track, and are difficult to open. Additionally, continued wear results in a poor fit between the components, resulting in steam loss. Increased steam loss results in an increase in energy costs required to keep the food at the desired and often mandated preheated temperature.

Steam cabinets are normally incorporated in a food service line as an integral part of the line. As such, the guide rails, door track and door bumpers are formed integral with the cabinet. Once the components wear to a point requiring replacement, either the entire steam cabinet must be replaced, or the cabinet, along with portions of the steam line, must be completely disassembled and replaced. Complete disassembly, in order to replace or repair the individual components, is a difficult and time consuming procedure as the bumper and door track are often formed integral with the cabinet. As such, repair and/or replacement of worn components is expensive. Furthermore, such activity increases the down time of the food service line and correspondingly results in lost revenue to the food provider.

Accordingly, it is desirable to provide a door assembly, including a removable door bumper and a door track on which the doors ride, that can be attached to an existing steam cabinet in a quick and efficient manner. Such an assembly reduces down time and increases production and thus, more importantly, increases sales and profits.

SUMMARY OF THE INVENTION

It is, therefore, one object of the present invention to provide a retrofit cabinet door assembly for use with a steam cabinet.

To achieve the foregoing object, the present invention is a retrofit cabinet door assembly for an existing steam cabinet. The retrofit cabinet door assembly includes a door frame having a flange extending about at least a portion of a periphery of the door frame. The flange has a plurality of apertures therein to facilitate mounting of the door frame on the steam cabinet. The retrofit cabinet door assembly also includes a removable door track supported within the door frame, a removable door bumper positioned within and secured to the door frame, and a removable door positioned within the door frame and engaging the door track for movement within the door frame along the door track.

One advantage of the present invention is that a retrofit cabinet door assembly is provided which does not alter the operation or efficiency of the steam cabinet. Another advantage of the present invention is that the retrofit cabinet door assembly can be easily installed over the existing opening. Yet another advantage of the present invention is that the installation of the retrofit cabinet door assembly is such that it may be easily removed to replace any worn components.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
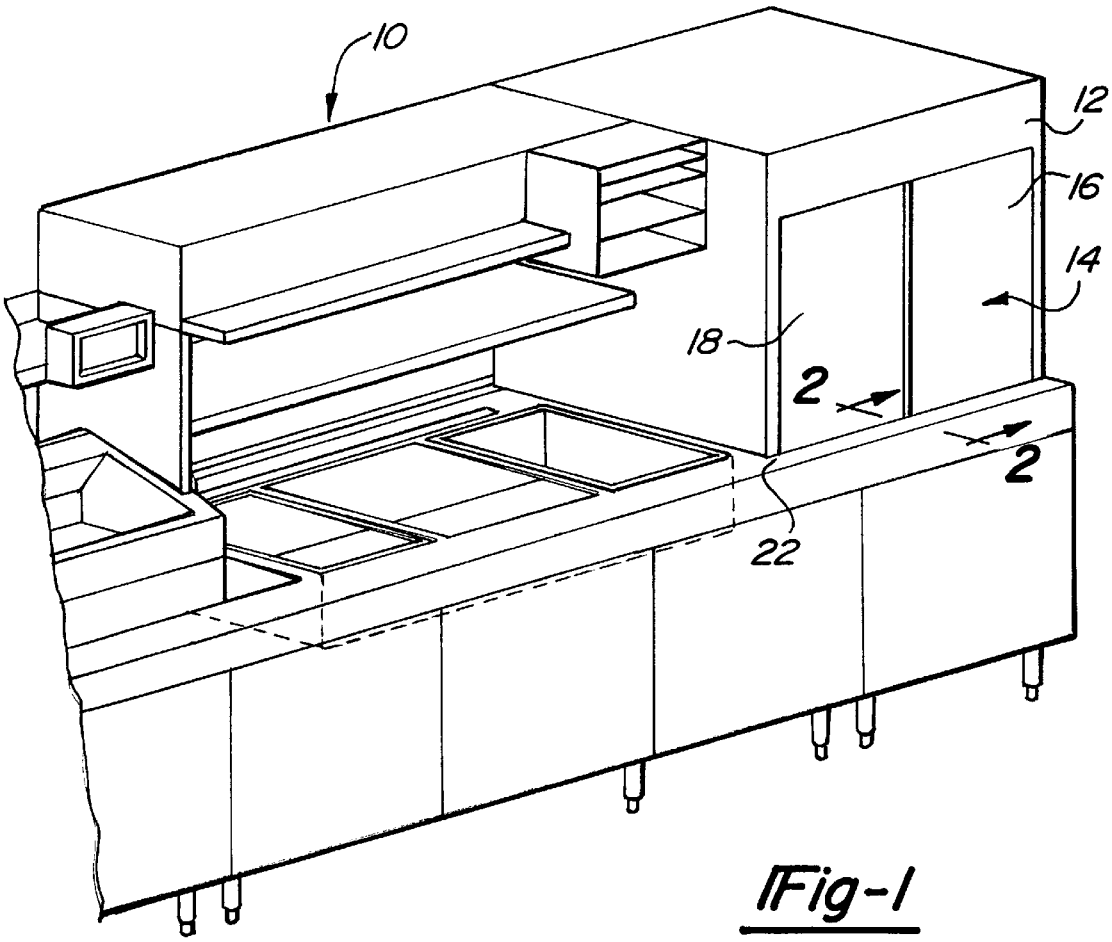
Fig-1 PRIOR ART
FIG. 1 is an overall perspective view of an existing steam cabinet used in a food service line.
Figure 2:
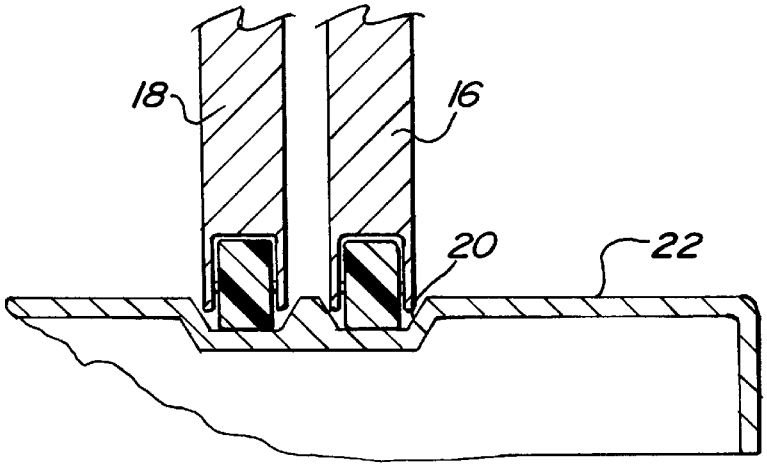
Fig-2 PRIOR ART
FIG. 2 is a sectional view taken along line 2—2 of FIG. 1.

Turning to the drawings, particularly FIGS. 1 and 2, a food service line 10 is shown. One component of the food service line 10 is a steam cabinet 12 in which food is kept warm or hot prior to preparation and serving. Typically, the steam cabinet 12 includes a door, generally indicated at 14. The door 14, as illustrated, includes a right door 16 and a left door 18 which slide back and forth on a door track 20. Continued movement of the doors 16 and 18, i.e., opening and closing the doors 16 and 18, causes wear in the door track 20 which is a permanent fixture in a lower surface 22 of the steam cabinet 12 (FIG. 2).

Figure 3:
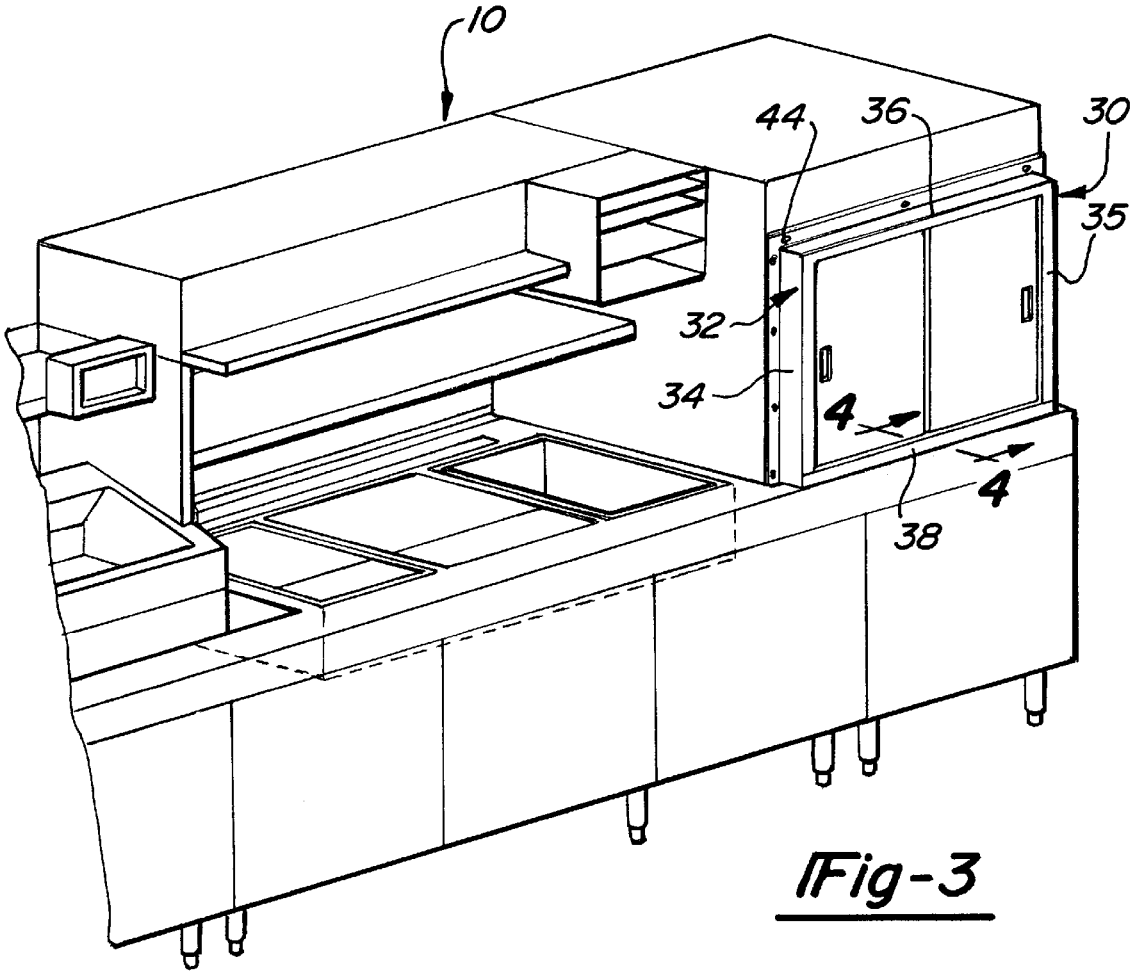
FIG. 3 is an overall perspective view of a retrofit cabinet door assembly, according to the present invention, shown attached to the existing steam cabinet of FIG. 1.
Figure 4:
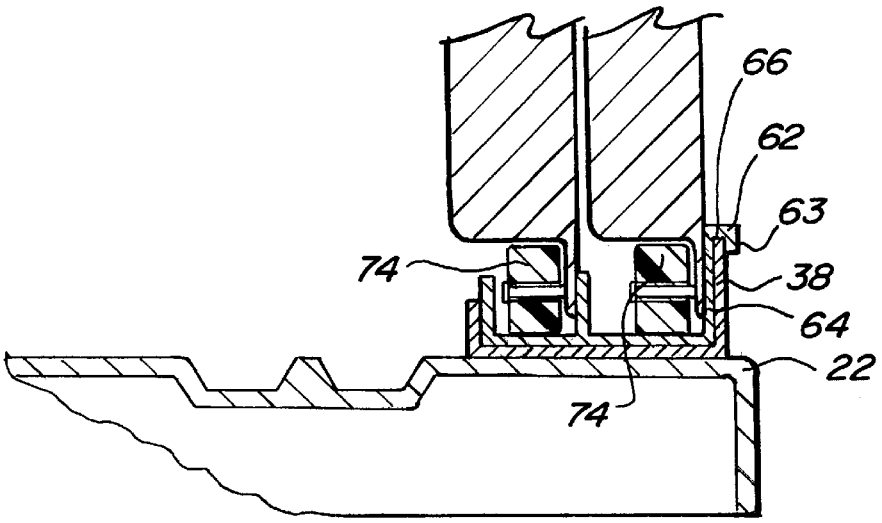
FIG. 4 is a sectional view taken along line 4—4 of FIG. 3.
Figure 5:
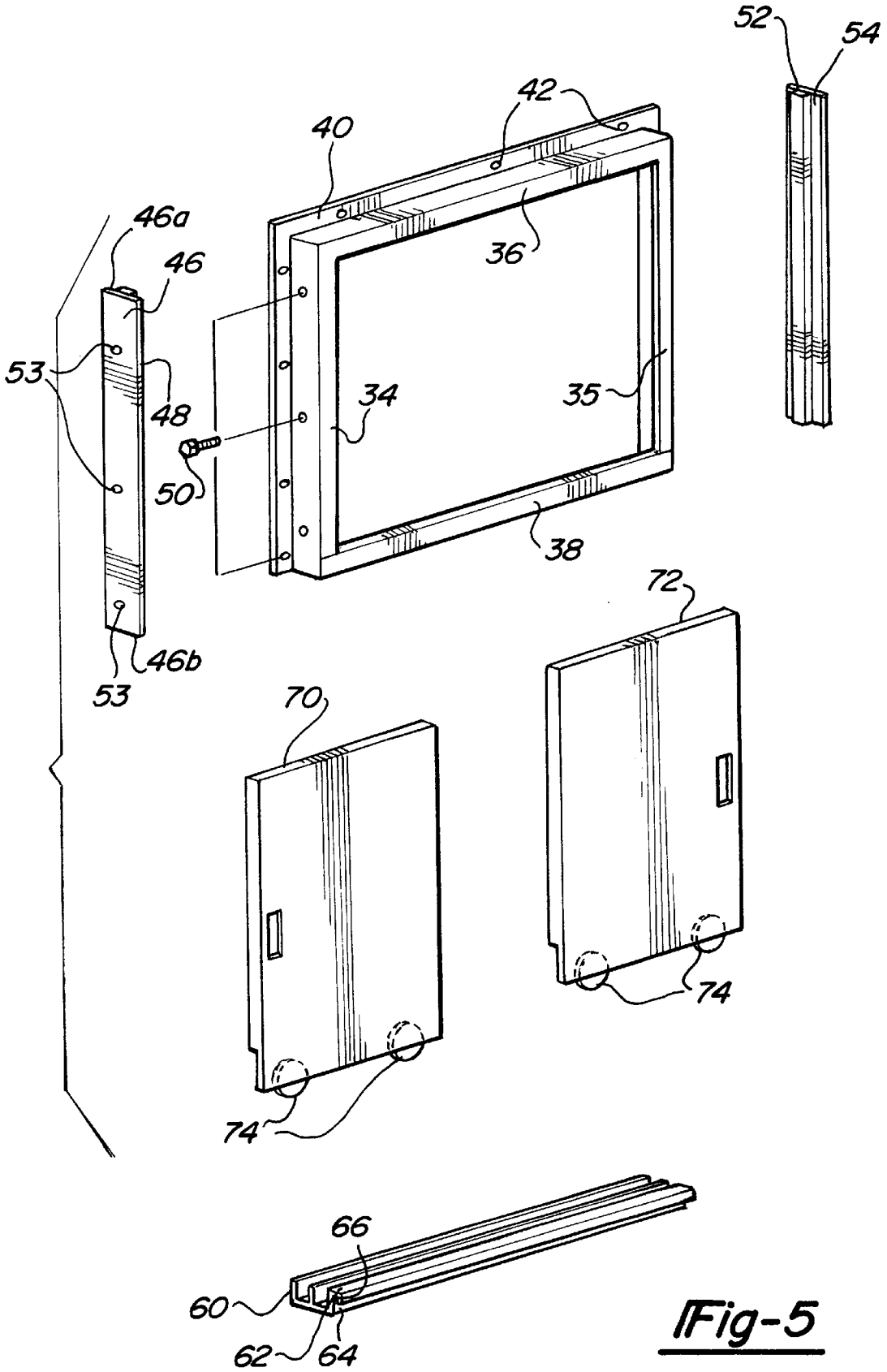
FIG. 5 is an exploded perspective view of the retrofit cabinet door assembly of FIG. 3.

Referring to FIGS. 3 through 5, a retrofit cabinet door assembly 30, according to the present invention, is shown installed on the existing steam cabinet 12. The retrofit cabinet door assembly 30 includes a door frame 32 made of a rigid material, preferably stainless steel. The retrofit cabinet door assembly includes opposite upright members 34, 35 and upper and lower cross members 36, 38 interconnected at their respective ends to form a door frame 32. As illustrated in FIG. 5, a flange 40 extends outwardly around the periphery of the upright members 34, 35 and the upper cross member 36. The flange 40 may be formed integral with the upright members 34, 35 and the upper cross member 36. As illustrated, the lower cross member 38 does not include a flange 40. Depending upon the door position or size of the opening of the steam cabinet 12, a flange 40 may be used on the lower cross member 38.

The upright members 34, 35 and the upper and lower cross members 36, 38 are permanently connected to one another at their respective ends. In the case of a stainless steel frame, this is accomplished by welding. If other materials are used, other suitable means to connect the individual frame components may be used. As illustrated in FIG. 5, the flange 40 includes a plurality of apertures 42. The apertures 42 are of a size suitable to accept a fastener (not shown) used to connect the door frame 32 to the steam cabinet 12.

The retrofit cabinet door assembly 30 also includes a left bumper 46 having a seal 48 attached thereto. The left bumper 46 is secured to the left upright member 34 by welding it to the left upright member 34 after the frame 32 is assembled. The bumper 46 may be welded at its upper and lower surfaces 46*a*, 46*b* to the left upright member 34 to secure it in place. Alternatively, the entire periphery of the bumper 46 may be welded to the frame 32. The bumper 46 may also be attached to the left upright member 34 via a plurality of threaded fasteners 50 extending through the apertures 51 on the left upright member 34 and engaging threaded bores 53 on the left bumper 46. Alternatively, the bores 53 may be through bores through which the fasteners 50 extend. A nut is placed on the fastener 50 to hold the bumper 46 in place. Additionally, a right bumper 52 also having a seal 54 secured thereto, is secured similarly to the right upright member 35 by welding. Again, a plurality of threaded fasteners 50 may also be used. One aspect or advantage of securing the respective left and right bumpers 46, 52 to the left and right upright members 34, 35 is that they may easily be removed and replaced when the respective seals 48, 54 become worn. It should be appreciated that other suitable types of fasteners, such as rivets or sheet metal screws, may also be used in place of the threaded fasteners 50.

The retrofit cabinet door assembly 30 also includes a door track 60 positioned in or on the lower cross member 38. A lip 62 extending outward from a front face 64 of the door track 60 includes a downwardly extending edge 63 that cooperates with the lip 62 to form a U-shaped channel 66 that extends over and secures to the door track 60 to the lower cross member 38. As illustrated, the door track 60 extends between the left and right bumpers 46, 52. A characteristic of such a mounting arrangement is that the door track 60 is removable and may be easily replaced when it becomes worn.

The retrofit cabinet door assembly 30 further includes left and right doors 70, 72 positioned within the door frame 32. The doors 70, 72 include stainless steel ball bearing rollers 74 attached thereto that allow the doors 70, 72 to move freely on the door track 60 within the door frame 32. It should be appreciated that the present invention provides a retrofit cabinet door assembly 30 that can be installed quickly and is easily maintained as all of the components can be easily removed and replaced in an efficient manner.

In its illustrated form, the retrofit cabinet door assembly 30 is installed on the existing steam cabinet 12 as follows. Initially, the existing steam cabinet doors 16, 18 must be removed. Most doors may be removed by grasping both sides of the door, lifting the door slightly and pulling out the bottom of the door. If possible, it is advisable to remove the existing steam door track. However, if not easily removed, removal of the existing door track will not affect installation of the retrofit cabinet door assembly 30. Once the doors and, if possible, the existing door track are removed, the door frame 32 is placed on the front of the existing steam cabinet 12. The bottom of the door frame 32 should be placed adjacent the existing door track 20 if it was removed or, if necessary, the bottom may be placed directly on top of the existing track. The flange 40 is then positioned against the front of the steam cabinet 12. While holding the door frame 32 in place, the locations of the apertures 42 are marked on the front of the steam cabinet 12. The door frame 32 is then removed and holes are then drilled at each of the marked locations. The holes should coincide such that they line up when the door frame 32 is placed adjacent the steam cabinet 12. Prior to using threaded fasteners 44 to secure the frame to the steam cabinet 12, a small bead of silicone, approximately one quarter of an inch thick, is applied to the backside of the door frame 32 just outside of the apertures 42. The silicone acts as a sealant between the door frame 32 and the steam cabinet 12. The door frame is then placed on the steam cabinet 12 and the drilled holes and the apertures 42 are lined up. Threaded fasteners 44 or pop rivets are then used to fasten the door frame 32 to the steam cabinet 12. Any silicone oozing from beneath the joint may be smoothed with a fingertip. The doors 70, 72 are then placed back in the frame 32 and the installation is complete.

Should any parts become worn, they may easily be removed from the door frame 32 thus providing a retrofit kit which may be installed quickly and efficiently and enabling the steam cabinet 12 to be maintained economically.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the invention may be practiced other than as specifically described.

What is claimed is:

1. A retrofit cabinet door assembly for a steam cabinet comprising:

a door frame including a flange extending about at least a portion of a periphery of said door frame, said flange having a plurality of apertures therein for mounting of said door frame to the steam cabinet;

a removable one-piece door track supported within said door frame, said door track being planar and extending longitudinally, said door track including an integral lip thereon, said lip including a downwardly extending edge that cooperates with said lip to form a U-shaped channel, said U-shaped channel fixedly securing said door track to said door frame;

a removable door bumper positioned within and secured to said door frame; and a removable door positioned within said door frame and engaging said door track for movement within said door frame along said door track.

2. A retrofit cabinet door assembly as set forth in claim 1 wherein said door frame includes a plurality of upright members and cross members interconnected at their respective ends to form said door frame.

3. A retrofit cabinet door assembly as set forth in claim 1 wherein said door frame is formed of stainless steel.

4. A retrofit cabinet door assembly as set forth in claim 1 wherein said door bumper includes a seal positioned on said door bumper to engage said door when said door is placed in a closed position.

5. A retrofit cabinet door assembly as set forth in claim 1 including a plurality of threaded fasteners to removably secure said door bumper to said door frame.

6. A retrofit cabinet door assembly as set forth in claim 1 wherein said door frame is removably mounted to the steam cabinet.

7. A retrofit cabinet door assembly as set forth in claim 6 including a plurality of threaded fasteners to removably mount said door frame to the steam cabinet.

8. A retrofit cabinet door assembly as set forth in claim 6 including a plurality of rivets to mount said door frame to the steam cabinet.

9. A retrofit cabinet door assembly as set forth in claim 1 wherein said door frame, said door track, said door bumper and said door are each made of stainless steel.

10. A retrofit cabinet door assembly for a steam cabinet comprising:

a door frame including a plurality of upright members and cross members, said upright members and said cross members interconnected to form said door frame;

a flange attached to and extending about a portion of the periphery of said door frame, said flange having a plurality of apertures therein;

a one-piece door track positioned within said door frame, said door track being planar and extending longitudinally and including an integral lip thereon, said lip including a downwardly extending edge that cooperates with said lip to form a U-shaped channel, said U-shaped channel fixedly securing said door track to said door frame;

a door bumper positioned within and secured to said door frame; and a door removably mounted on said door track within said door frame, said door including a plurality of rollers attached thereto, said rollers engaging said door track and facilitating movement of said door between an open and a closed position.

11. A retrofit cabinet door assembly as set forth in claim 10 wherein said door bumper includes a seal positioned on said door bumper to engage said door when said door is placed in said closed position.

12. A retrofit cabinet door assembly as set forth in claim 10 including a plurality of threaded fasteners to removably secure said door bumper to said door frame.

13. A retrofit cabinet door assembly as set forth in claim 10 including a plurality of fasteners extending through said flange and engaging the steam cabinet to removably secure said door frame to the steam cabinet.

14. A retrofit cabinet door assembly as set forth in claim 10 including a plurality of rivets extending through said plurality of apertures on said flange to mount said door frame to the steam cabinet.

15. A retrofit cabinet door assembly as set forth in claim 10 wherein said door frame is formed of stainless steel.

16. A retrofit cabinet door assembly as set forth in claim 10 wherein said door frame, said door track, said door bumper and said door are each made of stainless steel.

17. A method of retrofitting an existing steam cabinet with a retrofit cabinet door assembly comprising the steps of:

providing a door frame having a flange with a plurality of apertures and removable cabinet door assembly, the removable cabinet door assembly including a door track and a door bumper;

removing existing steam cabinet doors;

positioning the door frame along the front of the existing steam cabinet and holding the door frame in place while marking locations of the apertures;

removing the door frame and drilling holes at each of the marked locations;

positioning the door frame back in place on the existing steam cabinet and lining up the drilled holes and the apertures on the door frame; and fastening the door frame to the existing steam cabinet.

18. A method as set forth in claim 17 wherein said step of providing a door frame and removable cabinet door assembly including a door track and door bumper includes the step of attaching the door bumpers to the door frame and positioning and securing the door track within the door frame.

19. A method as set forth in claim 18 wherein prior to positioning the door frame back in place on the steam cabinet, a small bead of silicone is applied to the backside of the door frame such that the silicone provides a seal between the door frame and the steam cabinet when the door frame is fastened to the steam cabinet.

* * * * *